United States Patent [19]

Pozin

[11] 4,398,465

[45] Aug. 16, 1983

[54] INKING DEVICE FOR PRINTING MACHINE

[76] Inventor: Boris Pozin, 35-33 83rd St., #D6, Jackson Heights, N.Y. 11372

[21] Appl. No.: 376,553

[22] Filed: May 10, 1982

[51] Int. Cl.[3] ..... B41F 31/06

[52] U.S. Cl. ..... 101/36 S

[58] Field of Search ..... 101/365, 364, 363, 366, 101/350, 351, 154, 169, 207, 208, 157

[56] References Cited

U.S. PATENT DOCUMENTS

| | | | |
|---|---|---|---|
| 1,798,042 | 3/1931 | Smith | 101/365 |
| 1,905,104 | 4/1933 | Kerr | 101/157 X |
| 3,186,339 | 6/1965 | Turner et al. | 101/169 X |
| 3,877,369 | 4/1975 | D'Amato et al. | 101/363 X |
| 4,126,091 | 11/1978 | Cohen | 101/169 |

*Primary Examiner*—Paul T. Sewell
*Assistant Examiner*—Charles A. Pearson
*Attorney, Agent, or Firm*—Ilya Zborovsky

[57] ABSTRACT

An inking device for printing machines has an inking roller, an inking blade extending along an axial length of the roller, a plurality of adjusting members each displacing a respective portion of the inking blade to adjust the gap between the same and the inking roller, and two abutments against which all adjusting members can alternately abut to provide for maximum or minimum gap.

3 Claims, 1 Drawing Figure

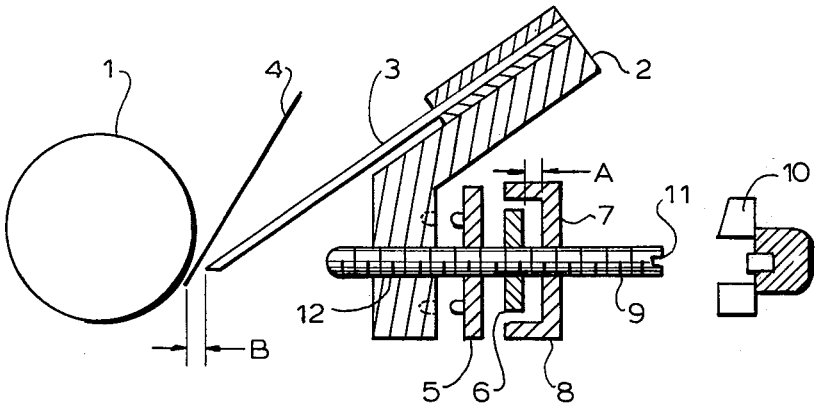
1
4
3
2
A
10
11
7
12
9
B
5
6
8

INKING DEVICE FOR PRINTING MACHINE

BACKGROUND OF THE INVENTION

The present invention relates to an inking device for printing machines.

Inking devices for printing machine of various types are known in the art. One of the known inking devices includes an inking roller, an inking blade extending substantially over the entire length of the inking roller, and a plurality of threaded members arranged at predetermined distances from one another along the extension of the inking blade and operative for displacing respective portions of the inking blade relative to the inking rollers so as to adjust at the locations of these portions a gap between the inking blade and inking roller. The inking blade can be either uninterrupted or composed of a plurality of segments adjoining each other. In the known inking device a first initial adjustment is performed with a high accuracy so as to provide for a required gap width over the entire axial length of the inking roller. However, during further use of the inking roller the positions of the threaded members are no longer known. Therefore, when it is necessary to perform a next required adjustment of the gap in the respective parts of the axial length of the inking roller, the procedure involved is extremely difficult and labor- as well as timeconsuming.

SUMMARY OF THE INVENTION

Accordingly, it is an object of the present invention to provide an inking device for a printing machine, which avoids the disadvantages of the prior art.

More particularly, it is an object of the present invention to provide an inking device in which adjustment of a gap between an inking blade and an inking roller is much easier and time-labor economical than in known inking devices.

In keeping with these objects and with others which will become apparent hereinafter, one feature of the present invention resides, briefly stated, in an inking device in which reference means is provided including two spaced abutments so that when all adjusting members located along the axial length of an inking roller abut against a respective one of said abutment either a minimum gap or a maximum gap is established along the entire length between the inking roller and the inking blade.

When the inking device is designed in accodance with the present invention, it is possible in any moment to readjust a gap between the inking roller and inking blade at any location or locations by returning all adjusting member to their joint position of abutting against a respective one of the two abutment and thereafter by displacing the respective adjusting members from this position.

The novel features of the present invention are set forth in the appended claims. The invention itself, however, will be best understood from the description of a preferred embodiment which is presented hereinbelow and accompanied by the drawing.

BRIEF DESCRIPTION OF THE DRAWING

The single FIGURE of the drawing is a view showing an inking device in a section taken transverse to the axis of an inking roller of the inventive inking device.

DESCRIPTION OF A PREFERRED EMBODIMENT

An inking device for printing machines, in accordance with the present invention has an inking roller which is identified by reference numeral 1 and an inking blade which is identified by reference numeral 3 and defines a gap B between the edge of the inking blade and the outer surface of the inking roller.

The inking blade 3 is mounted in a frame identified by reference numeral 2. The inking blade 3 is sufficiently elastic so that its portions spaced in an axial direction of the inking roller 1 can be displaced relative to the latter independently on one another. Alternately, the inking blade can be composed of a plurality of segments located adjacent to one another in the axial direction of the inking roller and independently displaceable relative to the latter. A clearance gauge 4 is utilized for determining and adjusting the gap B at various locations spaced in the axial direction of the inking roller.

Two abutments 5 and 8 are provided, spaced from one another. The abutments 5 and 8 are substantially plate-shaped and extend over substantially the entire axial length of the inking roller 1. The inking blade 3 also extends over substantially the entire length of the inking roller. As can be seen from the drawing, the abutment 8 is substantially cup-shaped and has a bottom part and a lateral part.

A plurality of adjusting members 9 formed substantially as screws are further provided. The adjusting members are arranged in spaced relationship relative to one another in the axial direction of the inking roller 1. Each adjusting member extends through a respective one of a plurality of openings 12 provided in the frame member 2. Each adjusting member 9 has a transverse part or shoulder identified by reference numeral 6.

Each adjusting member 9 is elongated and has a front end portion arranged to abut against the inking blade 3 at the respective location and a rear end portion facing away from the inking blade 3. The rear end portion of each of the adjusting members 9 has an engaging formation such as a groove 11. Finally, a distance indicating element such as micrometer 10 can be attached to the rear end portion of each of the adjusting members 9.

The inking device in accordance with the present invention operates in the following manner.

The plate-shaped abutment 5 with openings corresponding to the threaded openings 12 in the frame member 2 is fixedly attached to the frame member. Then the adjusting member 9 with the transverse part 6 which can be formed as a nut displacing over the thread of the adjusting member, is screwed into the threaded opening 12 of the frame member 2 with the aid of a tool introduced into the groove 11. The value of clearance or gap between the inking blade 3 or more particularly its edge and the inking roller 1, as well as the uniformity of the gap, along the entire axial length of the inking roller 1 is adjusted by the thickness gauge 4.

As long as the required width of the gap (minimum or practically equal to zero when supply of ink does not take place) is attained, the shoulders 6 are displaced so as to abut against the plate-shaped abutment 5 attached to the frame member 2, and then the shoulder is fixed on the respective member in this position, for example by welding 7. Now each adjusting member and its shoulder are integral with one another.

After this, the adjusting member 9 together with its shoulder 6 is removed from the threaded opening 12 after being marked to indicated to which part of the inking blade it belongs. Then the threaded opening 12 of the frame member 2 is drilled so that it is no longer threaded but instead is smooth and allows unobjectionable axial displacement of the adjusting member 9 therethrough.

Then the adjusting members with the shoulders are screwed into the respective threaded openings of the cup-shaped abutment 8 and the latter in assembled condition is attached to the frame member 2. When the cup-shaped abutment 8 is fixed to the frame member it forms a space limiting the displacement of the adjusting members 9 over a predtermined distance from minimum to maximum. The cup-shaped abutment 8 can abut by its lateral part against the abutment 5. The distance A corresponds to a maximum gap between the inking blade 3 and the inking roller 1 for a maximum ink supply.

When the adjusting member 9 is screwed so that its shoulder 6 abuts against the abutment 5, the gap between the inking blade and the inking roller is minimum. When, however, the adjusting member 9 is screwed so that its shoulder 6 abuts against the abutment 8, the gap is maximum at a location corresponding to this individual adjusting member.

After assembling the whole construction all screws are again adjusted in accordance with minimum or maximum distance by screwing them until their abutment against the abutment 5 and the abutment 8 (minimum or maximum gap). Then a micrometric measuring member is fitted onto the rear end of each of the adjusting members, which is preset in advance in the require minimum or maximum position.

At any time adjustment of the gap at any location can be performed by returning of the adjusting members to the front or rear abutments serving as reference surfaces, and then performing the required displacement of the respective adjusting members from this reference.

The rear surface of the frame member 2 can be manufactured with high quality and accuracy so as to serve as a reference surface. In this case the abutment 5 can be dispensed with.

The invention is not limited to the details shown since various modifications and structural changes are possible without departing in any way from the spirit of the present invention.

What is desired to be protected by Letters Patent is set forth in the appended claims.

I claim:

1. An inking device for printing machines, comprising an inking roller having an axis and a predetermined axial length;

an inking blade extending over substantially the entire length of said inking roller and having an edge displaceable relative to said inking roller so that a gap between said edge of said inking blade and said inking roller can be changed in a plurality of locations spaced from one another in an axial direction;

a frame member arranged to support said inking blade so that said inking blade is fixedly connected with said frame member;

a plurality of adjusting members each arranged in the region of a respective one of said locations and displaceable so as to displace said edge of said inking blade at the respective locations and thereby adjust the gap at these locations; and reference means including two abutments spaced from one another and arranged so that when all said adjusting members simultaneously abut against one of said abutments the gap is minimum at all said locations along substantially the entire length of said inking roller, and when all said adjusting members simultaneously abut against the other of said abutments the gap is maximum at all said locations along substantially the entire length of said inking roller, each of said abutments being formed as a substantially plate-like member attached to said frame member at a distance from one another in the direction of displacement of said adjusting members and extending substantially normal to said direction, one of said plate-shaped members having a projecting lateral part extending in said direction and abutting against the other of said plate-shaped members so as to form a compartment therebetween, each of said adjusting members including an elongated threaded part extending in said direction and having one end arranged to press against said inking blade at a respective one of said locations and a transverse part extending substantially normal to said direction and parallel to said plate-shaped members and displaceable inside said compartment formed by said plate-shaped members so as to abut against one or the other of said plate-shaped members.

2. An inking device as defined in claim 1, wherein said one abutment and said other abutment of said reference means are arranged on said frame member.

3. An inking device as defined in claim 1; and further comprising a plurality of distance indicating elements each associated with the other end of the elongated part of a respective one of said adjusting members.

* * * * *